United States Patent [19]

Loving, Jr. et al.

[11] 4,380,948

[45] Apr. 26, 1983

[54] LOADING OF WELLBORES WITH EXPLOSIVES

[75] Inventors: Frank A. Loving, Jr., Hagerstown, Md.; Walter J. Simmons, Martinsburg, W. Va.

[73] Assignee: E. I. Du Pont de Nemours and Company, Wilmington, Del.

[21] Appl. No.: 290,329

[22] Filed: Aug. 5, 1981

Related U.S. Application Data

[63] Continuation-in-part of Ser. No. 272,079, Jun. 10, 1981, abandoned.

[51] Int. Cl.[3] ..... C06D 1/08; F42B 3/00

[52] U.S. Cl. ..... 86/20 C; 102/313

[58] Field of Search ..... 86/20 C; 102/313, 322

[56] References Cited

U.S. PATENT DOCUMENTS

| | | | |
|---|---|---|---|
| 2,920,523 | 6/1957 | Barco et al. | 86/20 C |
| 3,148,580 | 9/1964 | Brown | 102/313 X |
| 3,986,430 | 10/1976 | Coursen et al. | 86/20 C |

*Primary Examiner*—Leland A. Sebastian
*Attorney, Agent, or Firm*—Diamond C. Ascani

[57] ABSTRACT

Bags of explosive are loaded rapidly into deep wellbores by suspending a rigid positioning tube partway into the wellbore, and loading the bags into the tube, the bags being prevented from dropping through the open bottom end of the tube by a cord attached to the lowermost bag and secured at the upper end of the tube when the tube-suspending cable is in tension by a cord-securing/releasing means, e.g., a pivotable bar having a hook on one end. When the bag-laden tube is lowered to the bottom of the wellbore, or to a column of bags previously placed therein, the tension on the cable is relaxed and the cord is released, allowing the positioning tube thereafter to be raised to the surface for re-use, leaving the cord and bags in the wellbore. Freedom of the bag-supporting cord to move with respect to the positioning tube when the latter is raised to the surface is assured by threading the cord through plastic tubing mounted to the wall of the positioning tube and releasable therefrom for re-use.

9 Claims, 4 Drawing Figures

LOADING OF WELLBORES WITH EXPLOSIVES

CROSS-REFERENCE TO RELATED APPLICATION

This application is a continuation-in-part of co-pending application Ser. No. 272,079, filed June 10, 1981 now abandoned.

BACKGROUND OF THE INVENTION

1. Field of the Invention

The present invention relates to a method of emplacing explosives in wellbores, e.g., for explosively fracturing gas- or oil-bearing formations, and to an apparatus for carrying out the method.

2. Description of the Prior Art

Explosives have been used for many years to fracture geologic formations containing oil and gas to improve the rate at which the hydrocarbons flow into the wellbore and thence are withdrawn to a surface collecting system. Explosives used for this purpose, usually high-strength gelatin dynamites containing a high percentage of nitroglycerin, are lowered into the well in rigid cartridges which do not fill the wellbore, leaving an annular space. This operation is hazardous in that subjecting nitroglycerin or nitroglycerin-based dynamite to friction and impact can result in premature detonation particularly in dry, gas-filled holes of the type encountered in the Devonian shale of the Appalachian basin.

Water gel or slurry explosive technology has provided an explosive system in recent years which virtually eliminates friction and impact hazards in loading and handling. There is a need, however, for a means to safely load bags or cartridges of water gel explosive into deep gas-filled wellbores in such a manner that the wellbore is filled from wall to wall to achieve a maximum explosive energy per foot of wellbore. Especially needed is a loading means which achieves a high loading rate, thus minimizing expensive drilling rig time during explosive treatment.

SUMMARY OF THE INVENTION

This invention provides a method of loading bags of explosive into a wellbore comprising:

(a) suspending in the wellbore a rigid bag-positioning tube having its open bottom end within the wellbore and its top end outside the wellbore, the top end of the positioning tube being adapted to receive a tube-suspending cable having one of its ends attached inside the tube and the other to an external tube-supporting fixture;

(b) threading a length of cord through a length of plastic tubing, one exposed end of the length of cord being provided with a loop and the other attached to a bag of explosive;

(c) introducing the bag of explosive into the positioning tube through an access port therein outside the wellbore, lowering the bag to the bottom of the tube, and attaching the loop on the end of the cord to a cord-securing/releasing means, e.g., a pivotable bar with a hook, affixed to an inside surface of the positioning tube adjacent the tube's top end, the cord-securing/releasing means acting in cooperation with the tube-suspending cable to secure the cord when the cable is placed under tension by the weight of the suspended tube, and to release the cord when the tension on the cable is relaxed, the tubing being releasably secured longitudinally to the inside wall of the positioning tube;

(d) dropping additional bags of explosive into the positioning tube;

(e) lowering the bag-laden tube to the bottom of the wellbore by paying out the tube-suspending cable, whereby relaxation of tension on the cable causes the cord to be released from the positioning tube; and (f) applying tension to the cable and thereby raising the positioning tube to the top of the wellbore whereby the bag-supporting cord and the bags of explosive remain in the wellbore.

After the positioning tube has been raised to the top of the wellbore, the plastic tubing can be released from the tube wall, and Steps (a) through (f) repeated until the desired number of bags of explosive have been deposited in the wellbore.

The invention also provides an apparatus for loading bags of explosive into a wellbore comprising:

(a) a rigid tube for positioning the bags in the wellbore, said tube having an open bag-releasing end and an opposite bag-receiving end adapted to receive a tube-suspending cable having one of it ends attached inside the tube and the other to an external tube-supporting fixture for suspending the tube in a wellbore, a portion of the wall of the tube near the bag-receiving end being removed to provide an access port for the introduction of bags of explosive;

(b) a bag-supporting cord threaded through a length of tubing and having one exposed end provided with a loop and the other exposed end adapted to be attached to a bag of explosive, the tubing being releasably secured longitudinally to the inside wall of the positioning tube; and (c) a cord-securing/releasing means affixed to the inside surface of the positioning tube adjacent its bag-receiving end, the cord-securing/releasing means acting in cooperation with the cable to secure the looped end of the cord when the cable is placed under tension, and to release the cord when the tension on the cable is relaxed.

BRIEF DESCRIPTION OF THE DRAWING

In the drawing, which shows specific embodiments of a preferred method and apparatus of the invention.

DETAILED DESCRIPTION

Figure 1:
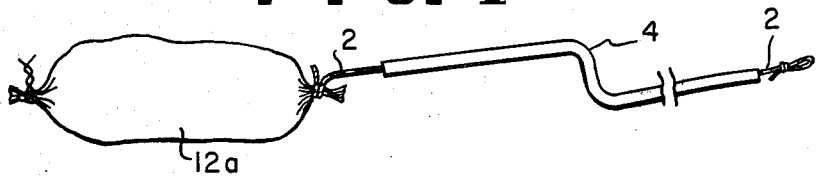
FIG. 1 is a schematic representation of a bag/cord assembly to be used in the present method.
Figure 2:
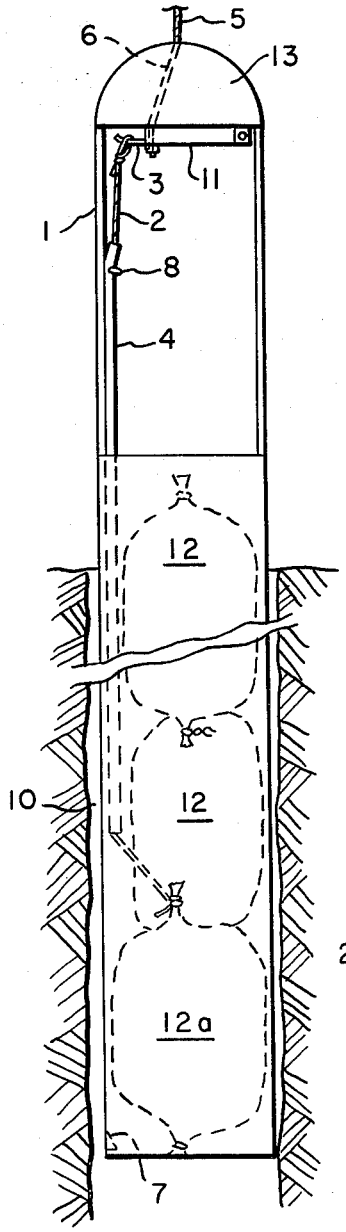
FIG. 2 is a schematic representation of a bag-positioning tube containing the assembly shown in FIG. 1 and suspended partway in a wellbore.
Figure 3:
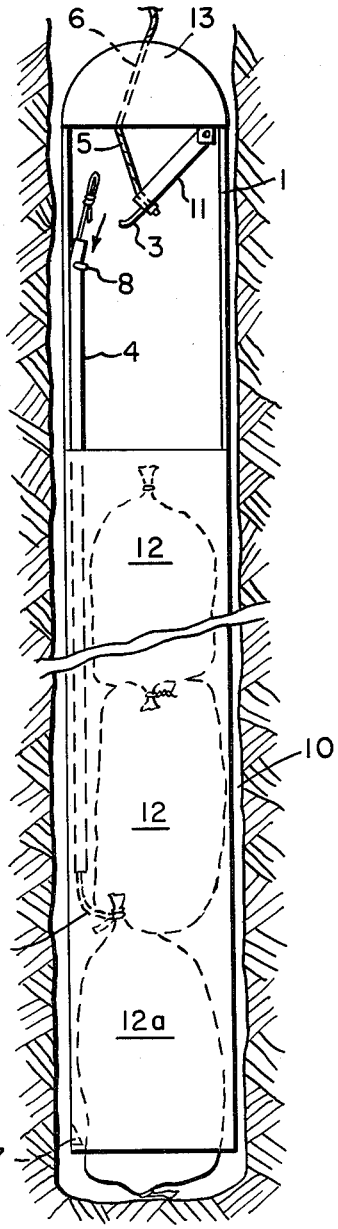
FIG. 3 is a schematic representation of the assembly shown in FIG. 2 after it has been lowered to the bottom of the wellbore.

Referring to FIGS. 2 and 3, 1 is a rigid tube for positioning bags of explosive 12 and **12*a* in wellbore 10. The bottom end of tube 1 is open, and adjacent the top end is solid hemispherical member 13, a fairing, provided with an aperture 6, which is a passageway for tube-suspending cable 5. Cable 5 leads from an external support fixture, e.g., a lowering and raising winch (not shown), through aperture 6 to bar 11. Bar 11 is pivotally attached at one end to the inside surface of tube 1, and at the opposite end has an aperture for receiving cable 5, held therein by any well-known means. A cord-grasping means 3, e.g., a hook, is affixed to the end of bar 11 to which cable 5 is attached. Bar 11 acts in cooperation with cable 5 to form a means of alternately securing and releasing a bag-supporting cord 2. As is shown in FIG. 1, one end of cord 2 is attached to a bag of explosive 12***a*, which is the first bag to be lowered into tube 1. Cord 2 is threaded through tubing 4 and has a loop at its free end for attachment to hook 3. By attachment to hook 3, cord 2 supports bags 12 and 12*a* while tube 1 is in suspended position in wellbore 10 (FIG. 2), bar 11 being held horizontal by a stop (not shown) diametrically positioned across the top end of tube 1. When tube 1 has been moved down to the bottom of the wellbore (FIG. 3), and support by cord 2 is no longer required, cord 2 is released from hook 3 so that raising of tube 1 back up to the surface leaves the bags behind in the wellbore. Tubing 4 provides protection for cord 2 to assure freedom of the cord's motion relative to tube 1 when tube 1 is raised.

A slitting knife 7 may be welded, silver-soldered or cemented at the bottom of tube 1 to slit the bags as they emerge from the tube. Lubricity is provided on the surface of the bags to assure their smooth exit without jamming inside tube 1. A clip 8 is provided to releasably secure tubing 4 to the inside wall of tube 1 permitting tubing 4 to be recovered after cord 2 and bags 12 have been released at the bottom of the wellbore. A side opening 9 at the top of the loading tube allows cord 2, tubing 4, and bags 12, 12*a*, to be inserted from the top so that the tube 1 may be loaded without complete withdrawal of the tube 1 from the wellbore.

Figure 4:
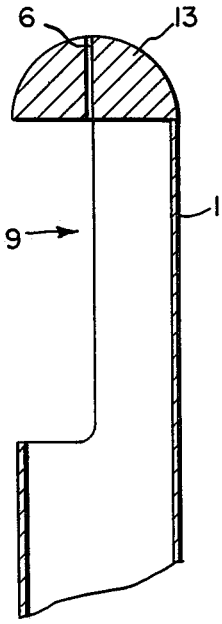
FIG. 4 is a cross-sectional side view of the upper portion of the bag-positioning tube shown in FIGS. 2 and 3.

In operation, a cord 2 of proper length is tied to a bag or cartridge 12*a* of explosive on the surface and drawn through tubing 4. The empty positioning tube 1 is raised above the top of the wellbore 10 to a convenient height, usually 1–2 meters. The first bag or cartridge with cord 2 and tubing 4 attached is lowered into the positioning tube 1 through the side opening 9 (FIG. 4), and the cord 2 is attached to the release hook 3. Lubricant is added as additional bags or cartridges are dropped into the positioning tube 1. The positioning tube 1 is lowered to the bottom of the wellbore 10 (FIG. 3). When tension is relaxed on cable 5, the hinged release hook 3 drops assisted by elastic tension in cord 2, releasing said cord from said release hook and allowing cord and bottom bag or cartridge followed by the other loaded bags or cartridges to be unloaded into the wellbore when the positioning tube 1 and tubing 4 are raised to the surface where the retrieved tubing is removed. The above process is repeated until the desired explosive load is deposited in the wellbore.

EXAMPLE

A bag-positioning tube was fabricated of Schedule 10 aluminum pipe having a welded closure at one end and having a length of about 7.2 meters, an inside diameter of 10.8 cm and an outside diameter of 11.4 cm. Tubing 4 was made of polyethylene, and had an inside diameter of about 1.3 cm, an outside diameter of about 1.6 cm, and a length of about 6.6 meters. The cord was nylon venetian blind cord of about 0.3 cm diameter. The lowering cable was 2.4-mm cable led by pulley to a high-speed winch for lowering and raising. The bags of explosive were "chub" cartridges, i.e., sausage-like bags, 10.2 cm in diameter, about 50.8 cm long, weighing 5.7 kg each, and slightly underfilled to permit cord 2 to be tied to one end. The packaging material was cross-laminated oriented polyethylene film 0.1 mm in thickness. The surface between the bags and loading tube was lubricated with a 0.5% solution of polyacrylamide in water. Using the described method and apparatus, five Devonian shale gas wells having a wellbore of 16.5 cm diameter and depths of about 1380 to 1470 meters were loaded with about 5500 kg each of water gel explosive by the described procedure. After a brief training period for operators, loading rates of 910 kg per hour could be maintained. Successful stemming and firing of the charges was accomplished by conventional means.

It will be understood that alternative materials of fabrication may be used in the apparatus and method of the invention. For example, the positioning tube may be made of steel, copper, any structural metal alloy, a rigid plastic, neoprene, rubber, or other such material. The tubing which is used around the bag-supporting cord may be made of nylon, polypropylene, vinyl polymers or copolymers, or other plastics and elastomers requiring only (1) sufficient flexibility to permit lowering of the first bag into the positioning tube and (2) sufficient resistance to collapse so that pressure from loaded bags will not collapse the tube and prevent exit of the cord. The bag containing the explosive may be made of any packaging film such as single-layered polyethylene, polypropylene, nylon, vinyl, polyester, and any of the numerous laminated constructions commonly employed as packaging materials. The term "bag" applies to sausage-like "chub" cartridges as well as to other conventional packages. The cord may be made of polyester, cotton, sisal, or other such combustible material providing sufficient tensile strength to withstand the impact of loaded bags and the weight of the finished load. Alternative lubricants include talc, graphite, grease, oil and "Teflon" fluorocarbon coating inside the loading tube. The slitting knife may be made of tungsten carbide, tool steel, stainless steel or any knife-quality metal alloy.

We claim:

1. A method of loading bags of explosive into a wellbore comprising:

(a) suspending in the wellbore a rigid bag-positioning tube having its open bottom end within the wellbore and its top end outside the wellbore, said top end being adapted to receive a tube-suspending cable having one of its ends attached inside said positioning tube and the other to an external tube-supporting fixture;

(b) threading a length of cord through a length of plastic tubing, one exposed end of said length of cord being provided with a loop and the other attached to a bag of explosive;

(c) introducing said bag of explosive into said positioning tube through an access port therein above the top of the wellbore, lowering said bag to the bottom of said tube, and attaching the loop on the end of said length of cord to a cord-securing-/releasing means affixed to an inside surface of said positioning tube adjacent its top end, said cord-securing/releasing means acting in cooperation with said cable to secure said cord when said cable is placed under tension by the weight of the suspended tube, and to release said cord when the tension on said cable is relaxed, said tubing being releasably secured longitudinally to the inside wall of said positioning tube;

(d) dropping additional bags of explosive into said positioning tube;

(e) lowering the bag-laden tube to the bottom of the wellbore by paying out the tube-suspending cable, whereby relaxation of tension on the cable causes said cord to be released from said tube; and (f) applying tension to the cable and thereby raising said positioning tube to the top of the wellbore whereby the released bag-supporting cord and the bags of explosive remain in the wellbore.

2. A method of claim 1 wherein said loop on one end of said bag-supporting cord is attached to a grasping means affixed to one end of a bar having its other end pivotally attached to said positioning tube near its top end, said tube-suspending cable being attached to said bar near said grasping means and causing said bar to assume a substantially horizontal position against an inner end surface of the top end of said positioning tube owing to the tension on said cable, said cord being released from said bar when relaxation of tension on said cable causes said bar to pivot out of the substantially horizontal position.

3. A method of claim 1 wherein said plastic tubing is released from the wall of said bag-lowering tube, and Steps (a) through (f) are repeated until the desired number of bags of explosive have been deposited in the wellbore.

4. A method of claim 1 wherein inwardly projecting cutting means is mounted on said bag-positioning tube in the vicinity of the bottom end thereof, and said bags are cut open by the motion of said cutting means when said tube is raised.

5. A method of claim 1 wherein a lubricant is applied to the surface of the bags of explosive dropped into said tube.

6. A method of claim 5 wherein said lubricant is a dilute solution of polyacrylamide.

7. Apparatus for loading bags of explosive into a wellbore comprising:

(a) a rigid tube for positioning the bags in the wellbore, said tube having an open bag-releasing end and an opposite bag-receiving end adapted to receive a tube-suspending cable having one of its ends attached inside said tube and the other to an external tube-supporting fixture for suspending said tube in a wellbore, a portion of the wall of said tube near said bag-receiving end being removed to provide an access port for the introduction of bags of explosive;

(b) a bag-supporting cord threaded through a length of tubing and having one exposed end provided with a loop and the other exposed end adapted to be attached to a bag of explosive, said tubing being releasably secured longitudinally to the inside wall of said positioning tube; and (c) a cord-securing/releasing means affixed to an inside surface of said positioning tube adjacent its bag-receiving end, said cord-securing/releasing means acting in cooperation with said cable to secure the looped end of said cord when said cable is placed under tension, and to release said cord when the tension on said cable is relaxed.

8. Apparatus of claim 7 wherein said cord-securing-/releasing means is a bar having one end pivotally attached to said positioning tube near its bag-receiving end, and having a cord-grasping means affixed to its other end, said tube-suspending cable also being attached to said bar near said cord-grasping means, tension on said cable causing said bar to assume a position substantially normal to the tube's longitudinal axis whereby said grasping means secures said cord loop, and relaxation of tension on said cable causing said bar to pivot whereby said cord loop is released from said grasping means.

9. Apparatus of claim 8 wherein inwardly projecting cutting means is mounted on said bag-positioning tube in the vicinity of the open end thereof.

* * * * *